US011248816B2

(12) United States Patent
Ikawa et al.

(10) Patent No.: US 11,248,816 B2
(45) Date of Patent: Feb. 15, 2022

(54) AIR CONDITIONER

(71) Applicant: DAIKIN INDUSTRIES, LTD., Osaka (JP)

(72) Inventors: Shinsuke Ikawa, Osaka (JP); Akio Tasaka, Osaka (JP); Yuusuke Shiono, Osaka (JP); Shinji Nagaoka, Osaka (JP); Daisuke Toyoda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 15/522,894

(22) PCT Filed: Sep. 29, 2015

(86) PCT No.: PCT/JP2015/077564

§ 371 (c)(1),
(2) Date: Apr. 28, 2017

(87) PCT Pub. No.: WO2016/067815

PCT Pub. Date: May 6, 2016

(65) Prior Publication Data

US 2017/0328620 A1 Nov. 16, 2017

(30) Foreign Application Priority Data

Oct. 31, 2014 (JP) ..... 2014-223397

(51) Int. Cl.
*F24F 11/36* (2018.01)
*F25B 49/02* (2006.01)
(Continued)

(52) U.S. Cl.
CPC ..... *F24F 11/36* (2018.01); *F25B 13/00* (2013.01); *F25B 49/022* (2013.01); *F25B 2400/12* (2013.01); *F25B 2500/222* (2013.01)

(58) Field of Classification Search
CPC ..... F24F 11/36; F24F 11/526; F24F 11/37; F25B 13/00; F25B 49/022; F25B 2400/12; F25B 2400/121; F25B 2500/222
See application file for complete search history.

(56) References Cited

U.S. PATENT DOCUMENTS 3,412,570 A * 11/1968 Pruett, Sr. ..... F25B 49/005 62/129
4,787,212 A * 11/1988 Hessey ..... F24F 11/30 62/129

(Continued)

FOREIGN PATENT DOCUMENTS

CN 202133061 U 2/2012
JP 6-180166 A 6/1994

(Continued)

OTHER PUBLICATIONS

International Search Report, issued in PCT/JP2015/077564 (PCT/ISA/210), dated Jan. 12, 2016.

(Continued)

*Primary Examiner* — Tavia Sullens
(74) *Attorney, Agent, or Firm* — Birch, Stewart, Kolasch & Birch, LLP

(57) ABSTRACT

An air conditioner which continues driving with a deteriorated gas leakage sensor is provided. An air conditioner of the present invention includes an outdoor unit including a compressor and an indoor unit connected with the outdoor unit and uses flammable refrigerant. The air conditioner includes: a refrigerant gas sensor; and a controlling unit configured to stop the compressor at occurrence of abnormality, when the refrigerant gas sensor detects refrigerant gas while the compressor is being driven. After the compressor is stopped as the refrigerant gas sensor detects the refrigerant gas, the controlling unit does not start driving of (Continued)

the compressor until an operation to cancel the abnormality is performed.

2 Claims, 8 Drawing Sheets

(51) Int. Cl.
*F25B 1/00* (2006.01)
*F25B 13/00* (2006.01)

(56) References Cited

U.S. PATENT DOCUMENTS 5,128,857 A * 7/1992 Okada ..... G05B 19/042 700/12
5,215,643 A * 6/1993 Kusanagi ..... G01N 27/4045 204/412
6,073,455 A * 6/2000 Tachigori ..... F24F 11/30 62/129
6,085,530 A * 7/2000 Barito ..... F25B 49/005 62/129
6,907,748 B2 6/2005 Kadle et al.
2011/0277541 A1 11/2011 Kadle et al.
2016/0245566 A1 * 8/2016 Hiraki ..... F25B 49/005

FOREIGN PATENT DOCUMENTS

JP 2000-356387 A 12/2000
JP 2011-117655 A 6/2011
JP 2012-13348 A 1/2012
JP 2013-151352 A 8/2013
WO WO-2015072311 A1 * 5/2015 ..... F24F 11/83

OTHER PUBLICATIONS

Extended European Search Report issued in corresponding PCT/JP2015/077564 dated Oct. 9, 2018.

* cited by examiner

AIR CONDITIONER

TECHNICAL FIELD

The present invention relates to an air conditioner using flammable refrigerant.

An air conditioner using flammable refrigerant, to which a refrigerant gas sensor is attached, has been known.

CITATION LIST

Patent Literature

[Patent Literature 1] Japanese Unexamined Patent Publication No. 2012-13348

SUMMARY OF INVENTION

Technical Problem

The refrigerant gas sensor may be deteriorated due to contact with high-density refrigerant. On this account, if the driving of the air conditioner starts without the replacement of the refrigerant gas sensor after the driving is stopped as the refrigerant gas sensor detects gas leakage, the refrigerant gas sensor may not be able to properly detect gas leakage.

In view of the above, an object of the present invention is to provide an air conditioner capable of preventing the continuance of driving with a deteriorated refrigerant gas sensor.

Solution to Problem

According to the first aspect of the invention, an air conditioner includes an outdoor unit including a compressor and an indoor unit connected with the outdoor unit and uses flammable refrigerant, the air conditioner comprising: a refrigerant gas sensor; and a controlling unit configured to stop the compressor at occurrence of abnormality, when the refrigerant gas sensor detects refrigerant gas while the compressor is being driven, after the compressor is stopped as the refrigerant gas sensor detects the refrigerant gas, the controlling unit not starting driving of the compressor until an operation to cancel the abnormality is performed.

In this air conditioner, after the compressor is stopped as the refrigerant gas sensor detects the refrigerant gas, the driving of the compressor does not start until the cancellation of the abnormality is carried out. It is therefore possible to prevent the driving of the air conditioner from being continued with the deteriorated refrigerant gas sensor.

According to the second aspect of the invention, the air conditioner of the first aspect further includes a notification unit configured to notify the occurrence of the abnormality, the notification unit continuing notification until the operation to cancel the abnormality is performed.

In this air conditioner, when the compressor is stopped as the refrigerant gas sensor detects the refrigerant gas, the occurrence of the abnormality is notified and the notification is continued until the abnormality is canceled. It is therefore possible to notify a user that the driving of the compressor is not started on account of the occurrence of the abnormality.

According to the third aspect of the invention, the air conditioner of the first or second aspect further includes a controller used for an operation regarding the driving of the air conditioner, the operation to cancel the abnormality being a special operation performed by using the controller.

In this air conditioner, an operation to cancel the abnormality when the compressor is stopped as the refrigerant gas sensor detects the refrigerant gas is a special operation using the controller. It is therefore possible to prevent the user from performing the cancelation of the abnormality without replacing the refrigerant gas sensor.

Advantageous Effects of Invention

As described above, the present invention brings about the following advantageous effects.

According to the first aspect of the invention, after the compressor is stopped as the refrigerant gas sensor detects the refrigerant gas, the driving of the compressor does not start until the cancellation of the abnormality is carried out. It is therefore possible to prevent the driving of the air conditioner from being continued with the deteriorated refrigerant gas sensor.

According to the second aspect of the invention, when the compressor is stopped as the refrigerant gas sensor detects the refrigerant gas, the occurrence of the abnormality is notified and the notification is continued until the abnormality is canceled. It is therefore possible to notify the user that the driving of the compressor is not started on account of the occurrence of the abnormality.

According to the third aspect of the invention, an operation to cancel the abnormality when the compressor is stopped as the refrigerant gas sensor detects the refrigerant gas is a special operation using the controller. It is therefore possible to prevent the user from performing the cancelation of the abnormality without replacing the refrigerant gas sensor.

DESCRIPTION OF EMBODIMENTS

The following will describe an air conditioner according to an embodiment of the present invention, with reference to drawings.

[Overall Structure of Air Conditioner]

Figure 1:
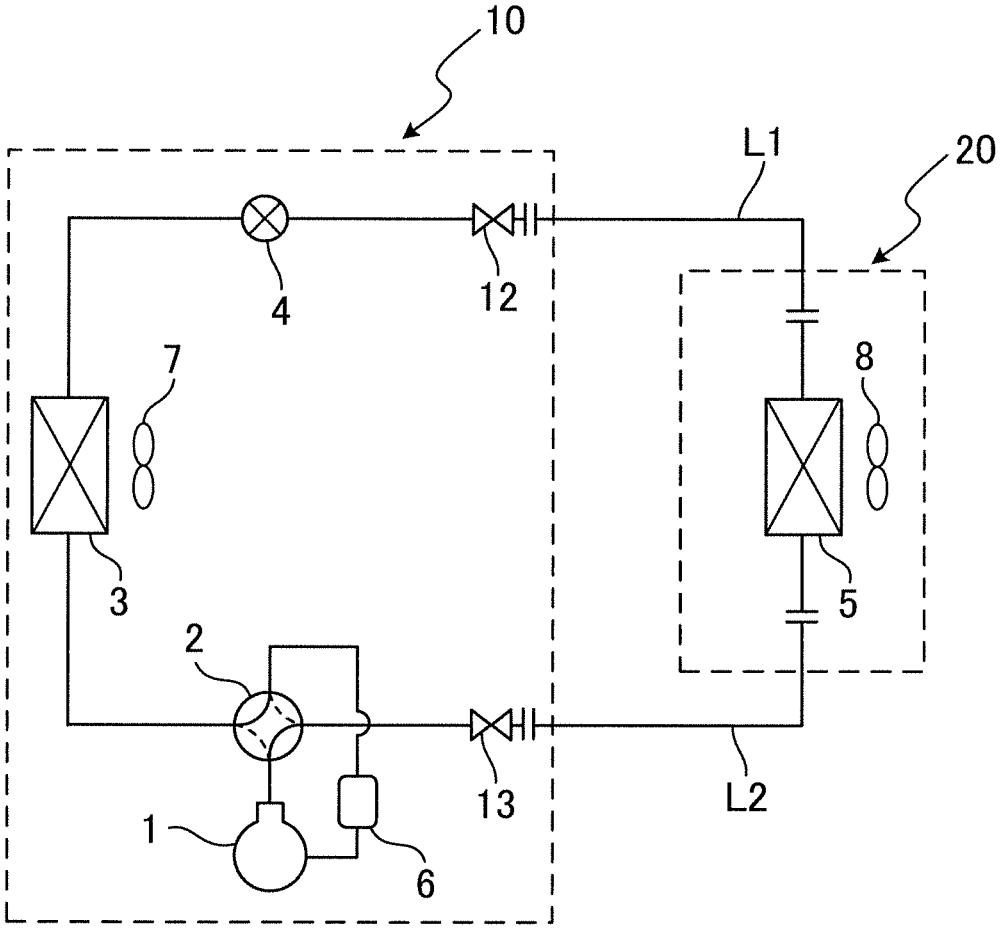
FIG. 1 is a circuit diagram showing a refrigerant circuit of an air conditioner of an embodiment of the present invention.

As shown in FIG. 1, an air conditioner of the present embodiment includes a compressor 1, a four-pass switching valve 2 having one end connected with the discharging side of the compressor 1, an outdoor heat exchanger 3 having one end connected with the other end of the four-pass switching valve 2, an electric expansion valve 4 having one end connected with the other end of the outdoor heat exchanger 3, an indoor heat exchanger 5 having one end connected with the other end of the electric expansion valve 4 via a stop valve 12 and a communication pipe L1, and an accumulator 6. The accumulator 6 has one end connected with the other end of the indoor heat exchanger 5 via a stop valve 13, a communication pipe L2, and the four-pass switching valve 2, and the other end connected with the sucking side of the compressor 1. The compressor 1, the four-pass switching valve 2, the outdoor heat exchanger 3, the electric expansion valve 4, the indoor heat exchanger 5, and the accumulator 6 form a refrigerant circuit.

In addition to the above, the air conditioner includes an outdoor fan 7 provided in the vicinity of the outdoor heat exchanger 3, and an indoor fan 8 provided in the vicinity of the indoor heat exchanger 5. The compressor 1, the four-pass switching valve 2, the outdoor heat exchanger 3, the electric expansion valve 4, the accumulator 6, and the outdoor fan 7 are provided in an outdoor unit 10, whereas the indoor heat exchanger 5 and the indoor fan 8 are provided in an indoor unit 20.

In this air conditioner, in a warming operation, as the four-pass switching valve 2 is switched to a position indicated by full lines and the compressor 1 is activated, high-pressure refrigerant discharged from the compressor 1 enters the indoor heat exchanger 5 through the four-pass switching valve 2. The refrigerant condensed in the indoor heat exchanger 5 is depressurized in the electric expansion valve 4 and then enters the outdoor heat exchanger 3. The refrigerant evaporated in the outdoor heat exchanger 3 returns to the sucking side of the compressor 1 via the four-pass switching valve 2 and the accumulator 6. In this way, a refrigerating cycle is formed such that the refrigerant circulates in the refrigerant circuit constituted by the compressor 1, the indoor heat exchanger 5, the electric expansion valve 4, the outdoor heat exchanger 3, and the accumulator 6. The room is warmed in such a way that room air is circulated by the indoor fan 8 through the indoor heat exchanger 5.

In the meanwhile, in a cooling operation (including a dehumidification operation), as the four-pass cooling operation 2 is switched to a position indicated by dotted lines and the compressor 1 is activated, high-pressure refrigerant discharged from the compressor 1 enters the outdoor heat exchanger 3 through the four-pass switching valve 2. The refrigerant condensed in the outdoor heat exchanger 3 is depressurized in the electric expansion valve 4 and then enters the indoor heat exchanger 5. The refrigerant evaporated in the indoor heat exchanger 5 returns to the sucking side of the compressor 1 via the four-pass switching valve 2 and the accumulator 6. In this way, a refrigerating cycle is formed such that the refrigerant circulates through the compressor 1, the outdoor heat exchanger 3, the electric expansion valve 4, the indoor heat exchanger 5, and the accumulator 6 in this order. The room is cooled in such a way that room air is circulated by the indoor fan 8 through the indoor heat exchanger 5.

This air conditioner uses flammable refrigerant. In the present invention, the term "flammable refrigerant" encompasses not only flammable refrigerant but also mildly flammable refrigerant. While the air conditioner uses R32 which is mildly flammable refrigerant, the air conditioner may use R290, for example. The air conditioner uses refrigerant having a higher specific gravity than air.

[Indoor Unit]

Figure 2:
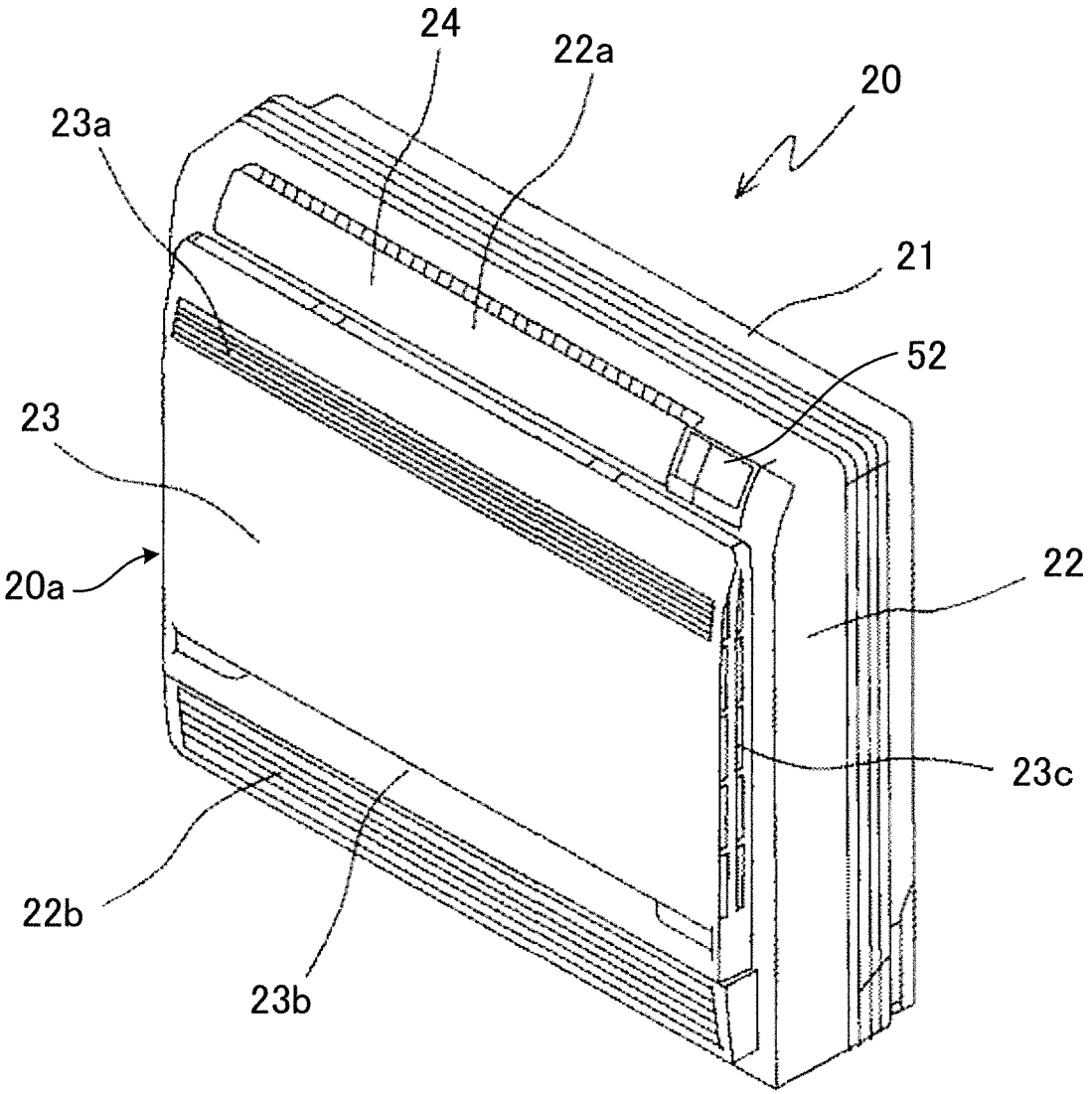
FIG. 2 is a perspective view of an indoor unit shown in FIG. 1.
Figure 3:
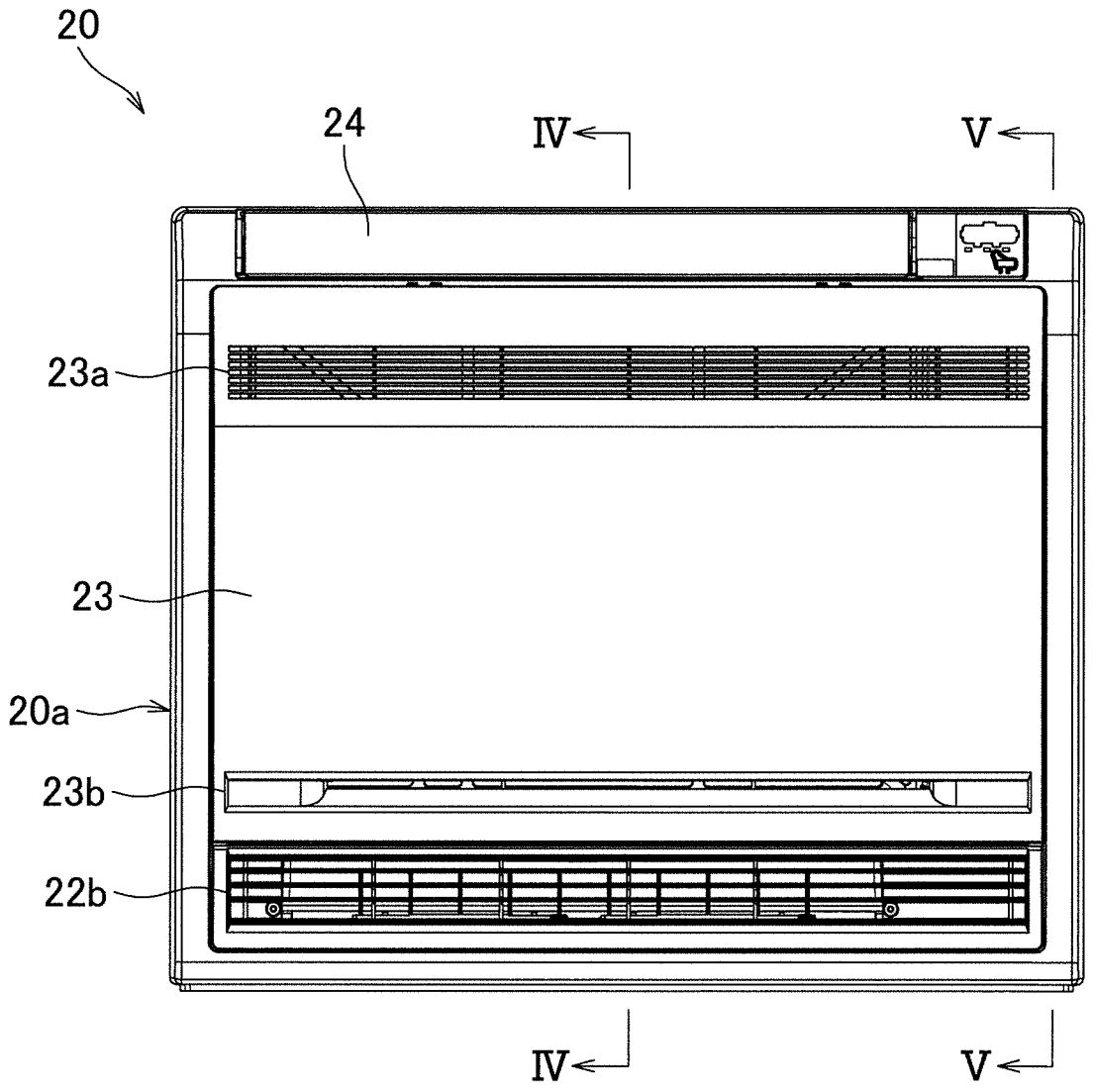
FIG. 3 is a front view of the indoor unit.
Figure 4:
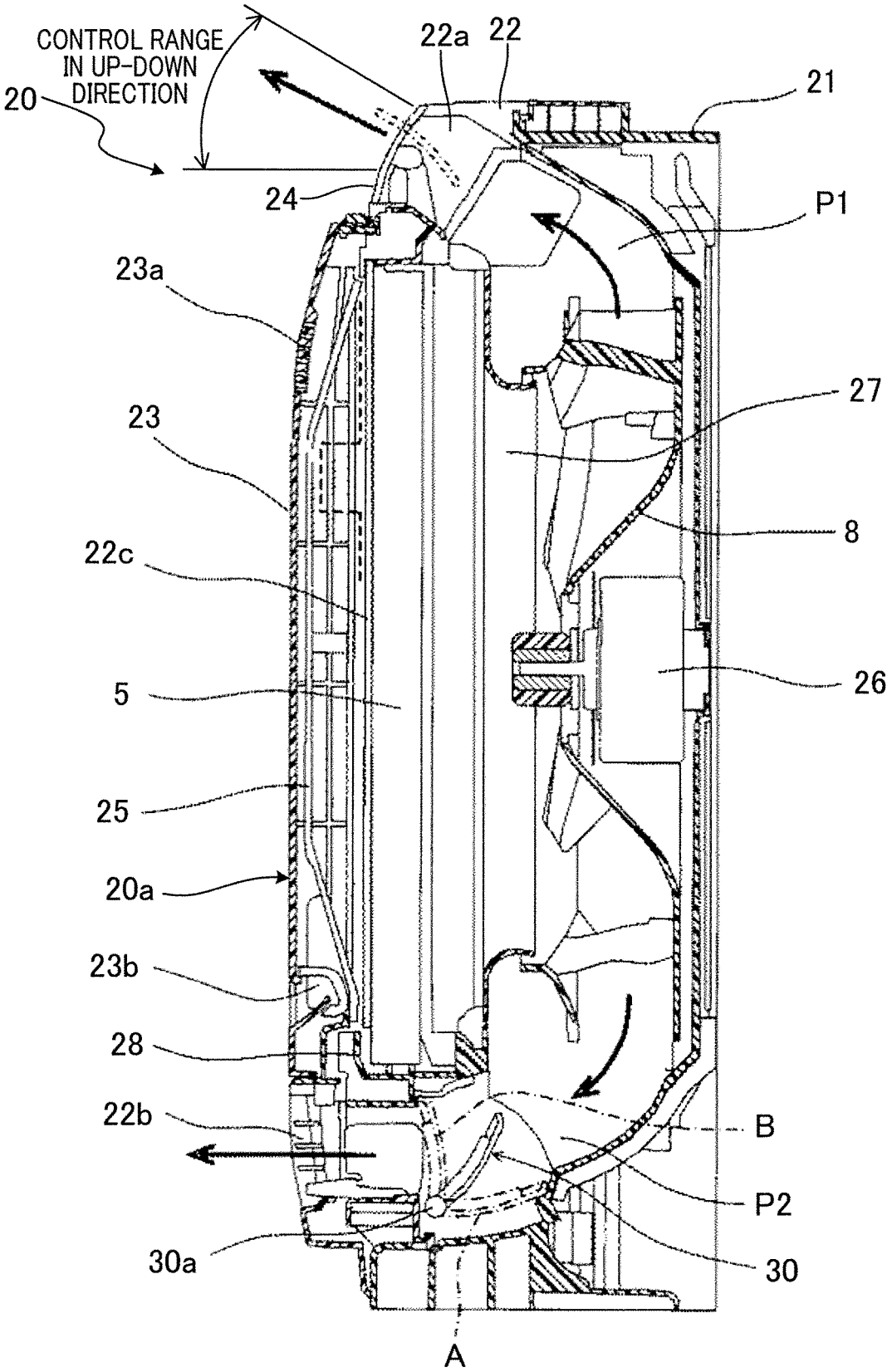
FIG. 4 is a cross section taken along the IV-IV line in FIG. 3.

As shown in FIG. 2 to FIG. 4, the indoor unit 20 is a floor-mounted indoor unit and includes a bottom frame 21 which is substantially rectangular in shape, the back surface side of the bottom frame 21 being attached to a wall of the room, a front grill 22 which is attached to the front surface side of the bottom frame 21 and has a substantially rectangular opening 22*c* in the front surface, and a front panel 23 attached to cover the opening 22*c* of the front grill 22. The bottom frame 21, the front grill 22, and the front panel 23 form a casing 20*a*.

An upper outlet port 22*a* is formed at an upper part of the front grill 22, whereas a lower outlet port 22*b* is formed at a lower part of the front grill 22. In an upper outlet path P1 communicating with the upper outlet port 22*a*, a vertical flap 24 is provided to change, in the up-down direction, the direction of the air flow blown out from the upper outlet port 22*a*. The vertical flap 24 is connected with a flap motor 24*a* (see FIG. 7). The vertical flap 24 is rotatable about the rotational axis along the horizontal direction, by the driving of the flap motor 24*a*. During the cooling operation or the warming operation, this vertical flap 24 rotates within a vertical wind direction control range shown in FIG. 4 so that cool wind or warm wind is blown out forward and obliquely upward from the upper outlet port 22*a*. During the operation stop, the upper outlet port 22*a* is closed as shown in FIG. 2.

At an upper part of the front grill 22, a display 52 is provided. On the display 52, the driving state of the indoor unit 20 is displayed. Furthermore, when the refrigerant gas leaks in the indoor unit 20 and the driving is stopped, information indicating that the driving has been stopped due to abnormality is displayed on the display 52.

In the meanwhile, in a lower outlet path P2 communicating with the lower outlet port 22*b*, a shutter 30 configured to open and close the lower outlet port 22*b* and a horizontal flap 31 configured to change, in the left-right direction, the direction of the air flow blown out from the lower outlet port 22*b* are provided. The shutter 30 is connected with a shutter motor 30*b*. As shown in FIG. 4, the shutter 30 rotates about the axis 30*a* extending along the horizontal direction, by the driving of the shutter motor 30*b*. This shutter 30 stops at a position A indicated by a one dot chain line to open the lower outlet port 22*b*, and stops at a position B indicated by a one dot chain line to close the lower outlet port 22*b*. The direction of the horizontal flap 31 is manually adjusted.

An upper inlet port 23*a* is formed at an upper part of the front panel 23, a lower inlet port 23*b* is formed at a lower part of the front panel 23, and side inlet ports 23*c* (only the right one is shown in FIG. 2) are formed through side faces of the front panel 23.

As shown in FIG. 4, a fan motor 26 is fixed at a substantial center of the bottom frame 21. The indoor fan 8 connected with the axis of the fan motor 26 is disposed in the bottom frame 21 so that the axis of the fan extends along the front-back direction. The indoor fan 8 is a turbofan which sucks air from the front surface side and blows the air radially outward with respect to the axis. The bottom frame 21 includes a bell-mouth 27 formed on the front surface side of the indoor fan 8. The indoor heat exchanger 5 is provided on the front surface side of the bell-mouth 27, and the front grill 22 is attached to the front surface side of the indoor heat exchanger 5. Furthermore, the front panel 23 is attached to the front surface side of the front grill 22. To the opening 22*c* of the front grill 22, a filter 25 is attached.

As the driving of the air conditioner starts, the fan motor 26 is driven so that the indoor fan 8 rotates. As the indoor fan 8 rotates, room air is sucked into the indoor unit 20 through the upper inlet port 23*a*, the lower inlet port 23*b*, and the side inlet ports 23*c*. The room air sucked into the indoor unit 20 is subjected to the heat exchange by the indoor heat exchanger 5, and is then blown out to the room through the upper outlet port 22*a* and the lower outlet port 22*b*. When the lower outlet port 22*b* is closed by the shutter 30, the room air sucked into the indoor unit 20 is blown out only through the upper outlet port 22*a*.

Figure 5:
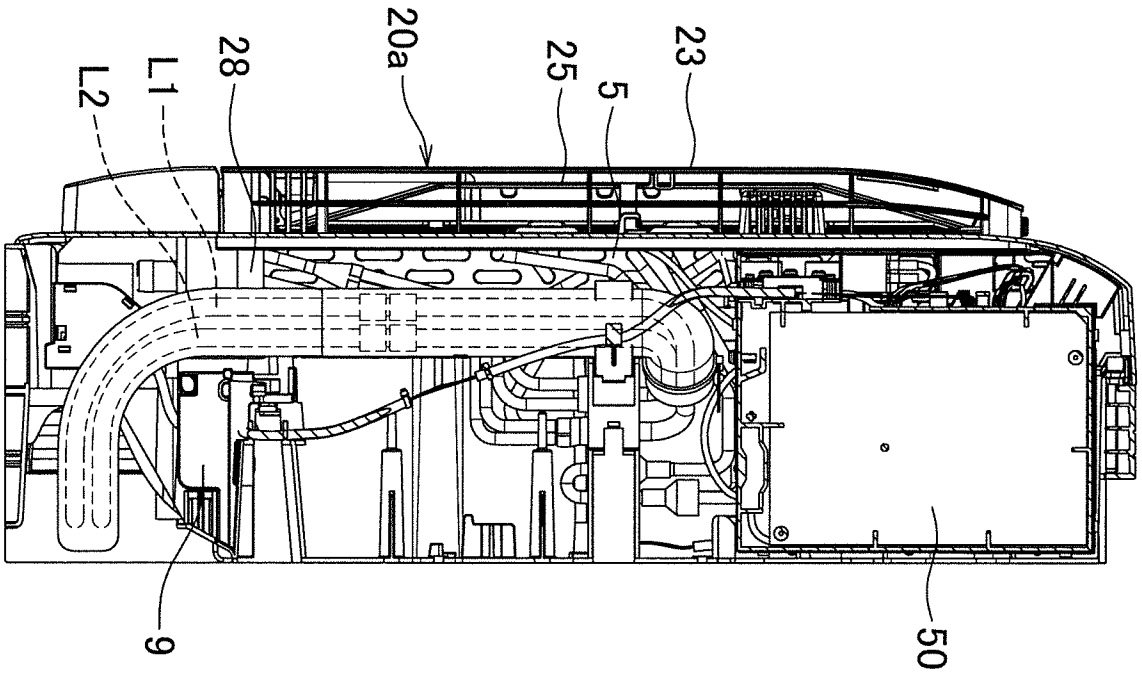
FIG. 5 is a cross section taken along the V-V line in FIG. 3.
Figure 6:
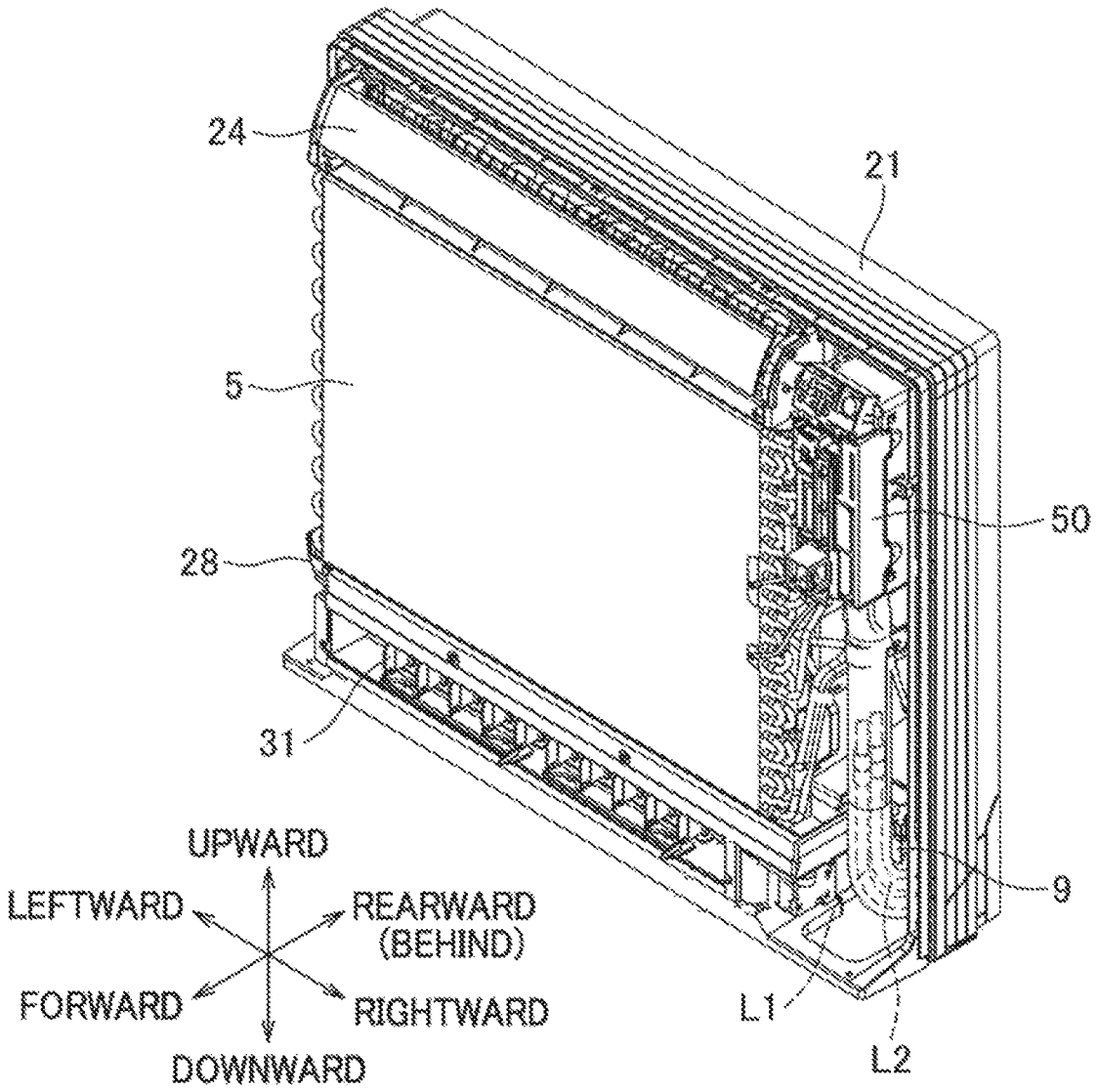
FIG. 6 is a perspective view of the indoor unit from which a front panel has been detached.

As shown in FIG. 5 and FIG. 6, a drain pan 28 is provided below the indoor heat exchanger 5 to receive and drain the condensed water from the air, which is generated on the indoor heat exchanger 5. Furthermore, an electronic component box 50 is provided to the right of (outside in the longitudinal direction) and above the indoor heat exchanger 5. Below the electronic component box 50, a refrigerant gas sensor 9 is detachably attached. This refrigerant gas sensor 9 is provided to the right of (outside in the longitudinal direction) the indoor heat exchanger 5 and the drain pan 28.

In this air conditioner, when refrigerant gas accidentally leaks out due to a reason such as the breakage of a refrigerant pipe in the indoor heat exchanger 5, the refrigerant gas having the higher specific gravity than air flows downward and reaches the drain pan 28. The refrigerant gas having reached the drain pan 28 flows from the left end side toward the right end side of the drain pan 28. On this account, the refrigerant gas having reached the drain pan 28 tends to overflow the drain pan 28 from the refrigerant gas sensor 9 side in the longitudinal direction. The overflow refrigerant gas stagnates at the bottom of the indoor unit 20, and leaks out of the indoor unit 20.

(Electronic Component Box)

Figure 7:
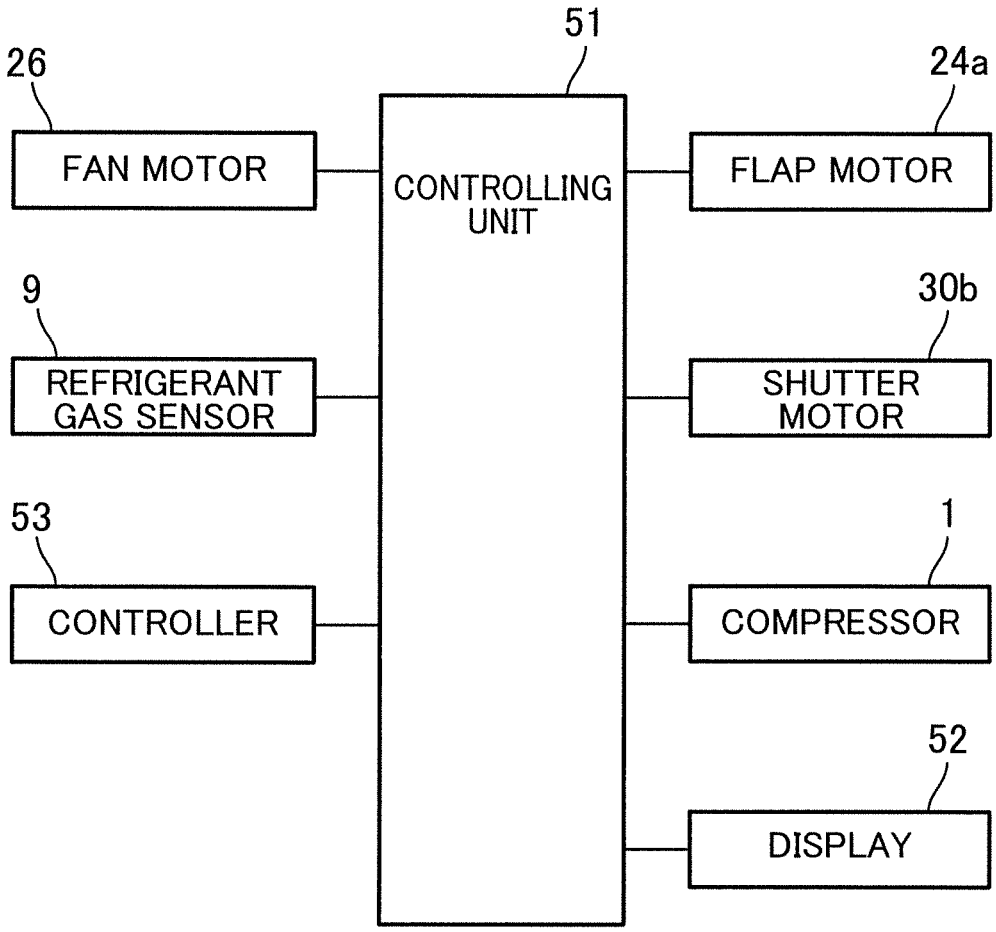
FIG. 7 shows a control block of the indoor unit.

The electronic component box 50 houses a controlling unit 51 therein for controlling components required for operations such as the cooling and warming operations of the air conditioner. As shown in FIG. 7, this controlling unit 51 is connected with the fan motor 26, the refrigerant gas sensor 9, the flap motor 24*a*, the shutter motor 30*b*, the compressor 1, the display 52, and a controller 53. The controlling unit 51 controls the indoor fan 8, the vertical flap 24, and the shutter 30, determines whether refrigerant leakage occurs based on a result of detection of the refrigerant gas by the refrigerant gas sensor 9, stops the compressor 1 upon detection of the refrigerant leakage, and displays information indicating the occurrence of abnormality on the display 52. By using the controller 53, for example, start or stop of the driving of the air conditioner and abnormality cancellation when the driving of the air conditioner is abnormally stopped due to refrigerant leakage are performed. The content of the operation is sent to the controlling unit 51. In the present embodiment, the abnormality cancellation by using the controller 53 is cancellation of abnormality, which indicates that the refrigerant gas sensor has been replaced. To prevent the user from performing the abnormality cancellation without replacing the refrigerant gas sensor 9, the abnormality cancellation is, for example, a special operation executable only by service technicians of air conditioners. The special operation is, for example, an operation that the users do not normally perform (e.g., long press of a button) or an operation which is executable only after the screen of the controller 53 is switched by an operation that the users do not normally perform (e.g., long press of a button). On this account, in the air conditioner of the present embodiment, when the driving is stopped for abnormality due to refrigerant leakage, even if the circuit breaker of the power source connected with the air conditioner is turned off and then turned on, the driving of the compressor 1 does not start until the abnormality cancellation is executed by using the controller 53.

(Refrigerant Gas Sensor)

The refrigerant gas sensor 9 is a sensor configured to detect leaked refrigerant gas, and is provided to be flush with or lower than the drain pan 28 as shown in FIG. 5. The refrigerant gas sensor is provided to the right of (outside in the longitudinal direction) the drain pan 28 and to be rearward of (i.e., behind) the drain pan 28 and the indoor heat exchanger 5. The refrigerant gas sensor may be a semiconductor sensor, a contact combustion type sensor, an electrochemical sensor, or the like.

Figure 8:
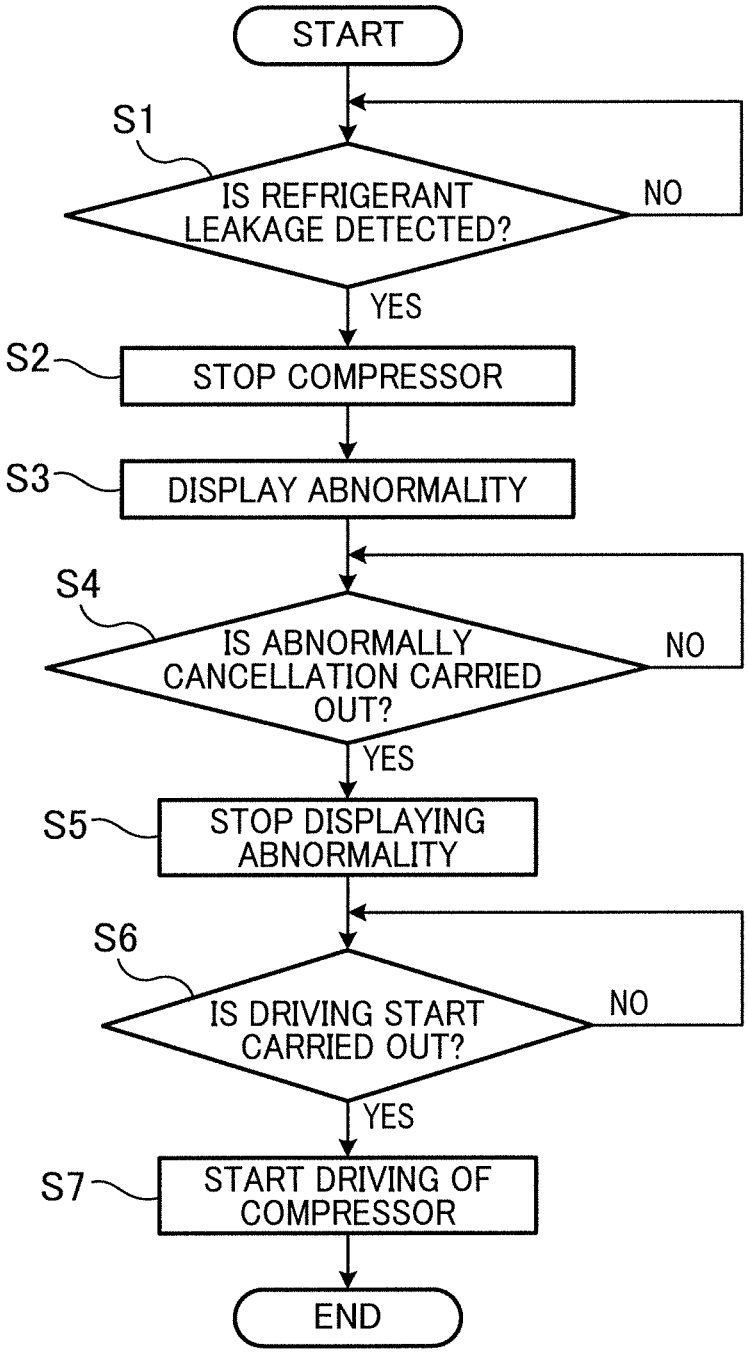
FIG. 8 is a flowchart showing processes executed when leakage of refrigerant gas is detected.

With reference to FIG. 8, the following will describe an operation executed when leakage of refrigerant gas is detected in the air conditioner of the present embodiment.

To begin with, during the driving of the air conditioner, whether refrigerant leakage has occurred is repeatedly determined based on results of detection of the refrigerant gas by the refrigerant gas sensor 9 (step S1). When the refrigerant leakage is detected (S1: YES), the compressor is stopped due to the occurrence of abnormality (step S2), and information indicating abnormal stop of the compressor is displayed on the display 52 (step S3).

The air conditioner of the present invention is arranged so that, when the compressor is stopped due to abnormality, the driving of the compressor 1 does not start until the refrigerant gas sensor 9 is replaced. On this account, whether abnormality cancellation has been done by using the controller 53 is repeatedly determined (step S4). When the abnormality cancellation has been done by using the controller 53 (S4: YES), the information indicating that the compressor is stopped due to abnormality is no longer displayed on the display 52 (step S5).

Thereafter, whether driving start has been instructed by using the controller 53 is repeatedly determined (step S6). When the driving start has been instructed (S6: YES), the driving of the compressor starts (step S7).

Characteristics of Air Conditioner of Present Embodiment

The air conditioner of the present embodiment has the following characteristics.

In the air conditioner of the present embodiment, after the compressor 1 is stopped as the refrigerant gas sensor 9 detects the refrigerant gas, the driving of the compressor 1 does not start until abnormality cancellation is carried out. It is therefore possible to prevent the driving of the air conditioner from being continued with the deteriorated refrigerant gas sensor 9.

In the air conditioner of the present embodiment, when the compressor 1 is stopped as the refrigerant gas sensor 9 detects the refrigerant gas, information indicating the occurrence of abnormality is displayed on the display 52. Because the information is continuously displayed until the abnormality cancellation is executed by using the controller 53, it is possible to notify the user that the driving of the compressor 1 does not start on account of the occurrence of the abnormality.

In the indoor unit of the air conditioner of the present embodiment, the abnormality cancellation when the compressor 1 is stopped as the refrigerant gas sensor 9 detects the refrigerant gas is a special operation executed by using the controller 53. It is therefore possible to prevent the user from performing the cancellation of the abnormality without replacing the refrigerant gas sensor 9.

Thus, the embodiments of the present invention have been described hereinabove. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

While in the embodiment above the driving of the compressor does not start until abnormality cancellation is carried out after the compressor is stopped as the refrigerant gas sensor detects the refrigerant gas, the cancellation of abnormality indicating that the refrigerant gas sensor has been replaced may not be carried out by using the controller.

In the embodiment above, information indicating the occurrence of abnormality is displayed on the display when refrigerant leakage is detected and the information is continuously displayed until the abnormality is canceled. In this regard, the occurrence of abnormality may be notified by a method different from the image display, or the occurrence of abnormality may not be notified.

While in the embodiment above the abnormality cancellation is a special operation executed by using the controller, the special operation may be different from the above.

While in the embodiment above the refrigerant gas sensor is provided in the indoor unit, the disclosure is not limited to this arrangement. The refrigerant gas sensor may be provided in the outdoor unit, and the effects of the present invention can be achieved by an air conditioner including the refrigerant gas sensor. While in the embodiment above the indoor unit is a floor-mounted indoor unit, the indoor unit may not be floor-mounted, and may be wall-mounted.

INDUSTRIAL APPLICABILITY

The present invention makes it possible to prevent the driving of the air conditioner from being continued with a deteriorated gas leakage sensor.

REFERENCE SIGNS LIST

1: compressor
9: refrigerant gas sensor
10: outdoor unit
20: indoor unit
51: controlling unit (controlling unit)
52: display (notification unit)
53: controller

The invention claimed is:

1. An air conditioner which includes:

an outdoor unit including a compressor and an outdoor heat exchanger; and an indoor unit connected with the outdoor unit and including an indoor heat exchanger, the compressor, the outdoor heat exchanger and the indoor heat exchanger connected with each other via pipes to form a refrigerant circuit wherein flammable refrigerant circulates, the air conditioner comprising:

a refrigerant gas sensor configured to contact gas of the flammable refrigerant leaked from the refrigerant circuit so as to detect the leakage, the refrigerant gas sensor being disposed in the indoor unit at a position separated from the refrigerant circuit, wherein the refrigerant gas sensor is configured to be deteriorated due to contact with high-density refrigerant;

a controlling unit electrically connected to the compressor and the refrigerant gas sensor, wherein the controlling unit is configured to:

determine whether the leakage has occurred or not, based on a result of detection by the refrigerant gas sensor;

stop the compressor upon determining that the leakage has occurred; and after the compressor is stopped, not start driving of the compressor until a first operation indicating that the refrigerant gas sensor has been replaced is performed;

a controller electrically connected to the controlling unit and configured to:

receive the first operation, performed by persons, and a second operation indicating start of driving of the air conditioner; and send first content corresponding to the first operation and second content corresponding to the second operation to the controlling unit, wherein the controlling unit is further configured to:

after the compressor has stopped upon determining that the leakage has occurred, determine whether the first content is received from the controller;

upon determining that the first content is received from the controller, further determine whether the second content is received from the controller; and start driving of the air conditioner upon determining that the second content has been received from the controller after receiving the first content from the controller.

2. The air conditioner according to claim 1, further comprising a notification unit electrically connected to the controlling unit and configured to perform notification that the leakage has occurred, wherein the controlling unit is configured to:

control the notification unit to perform the notification upon determining that the leakage has occurred; and after the notification is performed, control the notification unit to continue the notification until the first operation is performed.

* * * * *